US010102729B1

(12) United States Patent
Hill

(10) Patent No.: US 10,102,729 B1
(45) Date of Patent: Oct. 16, 2018

(54) SAFETY SYSTEM AND METHOD TO PREVENT UNATTENDED VEHICULAR OCCUPANTS

(71) Applicant: Katrina C. Hill, St. Petersburg, FL (US)

(72) Inventor: Katrina C. Hill, St. Petersburg, FL (US)

( * ) Notice: Subject to any disclaimer, the term of this patent is extended or adjusted under 35 U.S.C. 154(b) by 0 days.

(21) Appl. No.: 15/716,755

(22) Filed: Sep. 27, 2017

Related U.S. Application Data

(60) Provisional application No. 62/531,013, filed on Jul. 11, 2017.

(51) Int. Cl.
*G08B 21/02* (2006.01)
*G08B 21/22* (2006.01)

(52) U.S. Cl.
CPC ..... *G08B 21/02* (2013.01); *G08B 21/22* (2013.01)

(58) Field of Classification Search
None
See application file for complete search history.

(56) References Cited

U.S. PATENT DOCUMENTS 5,949,340 A * 9/1999 Rossi ..... B60N 2/002 340/425.5
6,922,147 B1 * 7/2005 Viksnins ..... B60N 2/002 180/272
7,012,533 B2 * 3/2006 Younse ..... B60N 2/002 180/273
7,123,157 B2 * 10/2006 Best ..... B60N 2/002 340/666
7,319,382 B1 * 1/2008 Vu ..... B60N 2/002 340/425.5
7,378,974 B1 * 5/2008 Bassett ..... G08B 21/02 340/573.1
7,786,852 B2 * 8/2010 Kautz ..... B60N 2/2812 340/425.5
7,830,270 B1 * 11/2010 Philbert ..... B60N 2/002 340/539.15
8,058,983 B1 * 11/2011 Davisson ..... G08B 21/0205 340/10.1
8,217,796 B2 * 7/2012 Trummer ..... B60N 2/2812 340/438
8,547,220 B1 * 10/2013 Dempsey ..... G08B 13/1627 340/539.12

(Continued)

FOREIGN PATENT DOCUMENTS

CN 204399048 U 1/2015

OTHER PUBLICATIONS

Valdez-Dapena, Peter, "New Tesla software to prevent hot car deaths," CNN Money, Sep. 21, 2016, http://money.cnn.com/2016/09/21/luxury/elon-musk-tesla-hot-car-deaths/.

*Primary Examiner* — Curtis King
(74) *Attorney, Agent, or Firm* — Brian T. Chew

(57) ABSTRACT

A safety system and method for redundant alerting to prevent unattended vehicular occupants is disclosed. Redundant alerts are presented on multiple devices to alert multiple different people of an unattended occupant, such as a child, in a vehicle. In some cases, further action may be taken to alarm local passersby or emergency services of the unattended occupant. Accordingly, there are multiple layers of security to prevent an unattended occupant from remaining in a potentially dangerous situation such as an overheating vehicle.

18 Claims, 5 Drawing Sheets

(56) References Cited

U.S. PATENT DOCUMENTS

| | | | | |
|---|---|---|---|---|
| 8,841,997 | B2 * | 9/2014 | Silveira | B60N 2/002 340/457 |
| 9,000,907 | B1 * | 4/2015 | Rembach | B60N 2/002 180/273 |
| 9,299,245 | B2 * | 3/2016 | Vartiainen | G08B 7/066 |
| 9,381,857 | B1 | 7/2016 | Arnold et al. | |
| 9,393,897 | B2 * | 7/2016 | Gomez-Collazo | B60N 2/002 |
| 9,460,262 | B2 * | 10/2016 | Kaufman | G06F 19/3418 |
| 9,811,995 | B2 * | 11/2017 | Gjoni | B60N 2/002 |
| 2002/0161501 | A1 | 10/2002 | Dulin et al. | |
| 2005/0035869 | A1 * | 2/2005 | Crook | G08B 21/14 340/632 |
| 2006/0139159 | A1 | 6/2006 | Lee et al. | |
| 2007/0046451 | A1 * | 3/2007 | Bihya | G08B 21/22 340/438 |
| 2009/0251312 | A1 * | 10/2009 | Shelton | G08B 5/222 340/539.13 |
| 2010/0321180 | A1 * | 12/2010 | Dempsey | G06Q 10/06 340/539.12 |
| 2011/0074565 | A1 * | 3/2011 | Cuddihy | B60N 2/002 340/457 |
| 2013/0033373 | A1 | 2/2013 | Thomas | |
| 2014/0285341 | A1 * | 9/2014 | Gitau | G08B 25/009 340/540 |
| 2015/0137962 | A1 * | 5/2015 | Binnicker | B60Q 9/00 340/457 |
| 2016/0007912 | A1 * | 1/2016 | Hu | A61B 5/002 600/595 |
| 2016/0082923 | A1 * | 3/2016 | Gavriel | B60R 22/48 340/438 |

* cited by examiner

SAFETY SYSTEM AND METHOD TO PREVENT UNATTENDED VEHICULAR OCCUPANTS

CROSS-REFERENCE TO RELATED APPLICATIONS

This application claims benefit of priority from U.S. Provisional Patent Application No. 62/531,013 filed on Jul. 11, 2017, the disclosure of which is incorporated herein by reference in its entirety.

BACKGROUND

1. Technical Field

The present disclosure relates generally to the field of safety systems. In particular, the present disclosure relates to safety systems and methods to prevent unattended vehicular occupants, and more particularly to prevent temperature-related deaths of children.

2. Description of Related Art

When the temperature within a vehicle or other confined space elevates, a dangerous situation can arise. Children, specifically infants or children without the ability to adequately convey a potentially dangerous situation, are at the mercy of other people to watch out for their safety. With a high demand on an adult's attention, there is a catastrophic potential for such a dangerous situation to go overlooked.

Current attempts have been made to address this problem. For example, there have been attempts to remotely alarm a caretaker when a child is inadvertently left in a car seat. However, there are instances when the caretaker may not receive the alarm or may be distracted during or after the alarm. In such instances, the child may remain left in the vehicle under dangerous conditions.

Based on the foregoing, there is a need in the art for a manner of alerting to ensure that a child passenger does not remain in the vehicle unattended.

The above problems in the related art are considered as matters that have been addressed by the inventor to derive the present inventive concept, or as matters discovered during the course of deriving the present inventive concept. Thus, the problems may not be simply referred to as information that was known to the general public prior to filing the present disclosure.

SUMMARY OF EMBODIMENTS

Various embodiments of the present disclosure include a safety system for redundant alerting to prevent unattended vehicular occupants in a vehicle. The safety system includes: an in-vehicle system including: a first processor; and at least one input device that transmits at least one signal to the first processor, wherein the first processor determines that a condition exists to perform redundant alerting based on the at least one signal from the at least one input device and transmits an alert to each of a plurality of mobile devices; and the plurality of mobile devices, each of the plurality of mobile devices including: an output device; and a second processor that provides the alert from the first processor to a user through the output device and indicates to the first processor that the alert has been cleared based on an input from the user, wherein the first processor performs remedial action if the first processor determines that all alerts to the plurality of mobile devices have not been cleared within a predetermined amount of time.

In an exemplary embodiment, the at least one signal includes a signal indicating that an occupant is detected in the vehicle.

In another exemplary embodiment, the at least one input device includes a motion-sensing camera, a weight sensor, or a pressure sensor.

In another exemplary embodiment, the at least one signal further includes a signal indicating that the vehicle is in a parked state or a signal indicating that doors of the vehicle have been closed for a predetermined amount of time.

In another exemplary embodiment, the plurality of mobile devices includes two mobile phones.

In another exemplary embodiment, the plurality of mobile devices further includes a multi-information display unit of the vehicle.

In another exemplary embodiment, the alert includes a prompt to input a code to clear the alert; and the second processor determines that the alert is cleared based on the input from the user matching a predetermined code.

In another exemplary embodiment, the alert includes a real-time image of an interior of the vehicle.

In another exemplary embodiment, the alert includes a prompt to set a timer to temporarily clear the alert.

In another exemplary embodiment, the remedial action includes at least one of electronically unlocking at least one door of the vehicle, electronically opening at least one window of the vehicle, electrically causing an alarm or horn to sound, and transmitting a message to emergency services.

Various embodiments of the present disclosure include a safety method for redundant alerting to prevent unattended vehicular occupants in a vehicle. The safety method includes transmitting, by at least one input device, at least one signal to a first processor of an in-vehicle system; determining, by the first processor, that a condition exists to perform redundant alerting based on the at least one signal; transmitting, by the first processor, a respective alert to each of a plurality of mobile devices in response to determining that the condition exists; providing, by a respective second processor of each of the plurality of mobile devices, the respective alert from the first processor to a respective user through a respective output device of each of the plurality of mobile devices; indicating, by the respective second processor, to the first processor that the respective alert has been cleared based on an input from the respective user; and performing, by the first processor, remedial action if the first processor determines that all alerts to the plurality of mobile devices have not been cleared within a predetermined amount of time.

In an exemplary embodiment, the transmitting at least one signal to the first processor includes transmitting a signal indicating that an occupant is detected in the vehicle.

In another exemplary embodiment, the at least one input device includes a motion-sensing camera, a weight sensor, or a pressure sensor.

In another exemplary embodiment, the transmitting at least one signal to the first processor further includes transmitting a signal indicating that the vehicle is in a parked state or a signal indicating that doors of the vehicle have been closed for a predetermined amount of time.

In another exemplary embodiment, the plurality of mobile devices includes two mobile phones.

In another exemplary embodiment, the plurality of mobile devices further includes a multi-information display unit of the vehicle.

In another exemplary embodiment, the providing the respective alert includes displaying a prompt to input a code to clear the respective alert, the method further including: determining, by the second processor, that the respective alert is cleared based on the input from the respective user matching a predetermined code.

In another exemplary embodiment, the providing the respective alert includes displaying a real-time image of an interior of the vehicle.

In another exemplary embodiment, the providing the respective alert includes displaying a prompt to set a timer to temporarily clear the alert.

In another exemplary embodiment, the performing the remedial action includes at least one of electronically unlocking at least one door of the vehicle, electronically opening at least one window of the vehicle, electrically causing an alarm or horn to sound, and transmitting a message to emergency services.

The foregoing, and other features and advantages, will be apparent from the following, more particular description of the exemplary and preferred embodiments, the accompanying drawings, and the claims.

BRIEF DESCRIPTION OF THE DRAWINGS

The present disclosure will become more fully understood from the specification and the accompanying drawings, wherein.

DETAILED DESCRIPTION OF EMBODIMENTS

Figure 1:
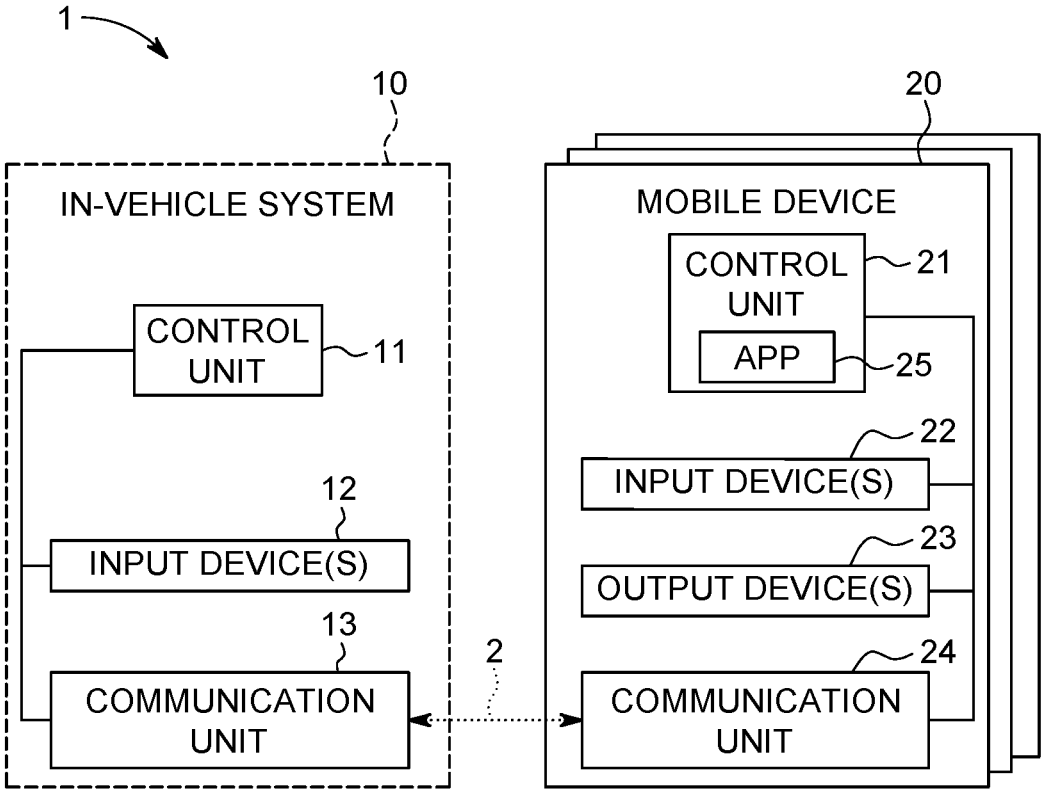
FIG. 1 is a block diagram of an exemplary system according to various embodiments.

The following description is merely exemplary in nature and is in no way intended to limit the various embodiments, their application, or uses. It should be understood that the terminology used herein is used for the purpose of describing particular embodiments only, and is not intended to limit the scope of the present disclosure. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may. Features that are described in the context of separate embodiments may also be provided in combination in a single embodiment. Conversely, various features that are, for brevity, described in the context of a single embodiment, may also be provided separately or in any suitable subcombination. New claims may be formulated to such features and/or combinations of such features during the prosecution of the present application or of any further application derived therefrom.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the various embodiments of the present disclosure. Structures described herein are to be understood also to refer to functional equivalents of such structures.

It should be understood that steps within a method may be executed in different order without altering the principles of the present disclosure. Additionally, the components and/or elements recited in any apparatus or system claim may be assembled or otherwise operationally configured in a variety of permutations and are accordingly not limited to the specific configuration recited in the claims.

As will be understood by one skilled in the art, all ranges recited herein also encompass any and all possible sub-ranges and combinations of sub-ranges thereof, as well as the individual values making up the range, particularly integer values. Any listed range can be easily recognized as sufficiently describing and enabling the same range being broken down into at least equal halves, thirds, quarters, fifths, or tenths. A recited range (e.g., weight percent, absolute weight) includes each specific value, integer, decimal, or identity within the range. As will also be understood by one skilled in the art, all language such as "up to," "at least," greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio. Accordingly, specified values recited for radicals, substituents, and ranges, are for illustration only; they do not exclude other defined values or other values within defined ranges for radicals and substituents.

The drawings described herein are for illustrative purposes only of selected embodiments and not all possible implementations, and are not intended to limit the scope of any of the various embodiments disclosed herein or any equivalents thereof. It is understood that the drawings are not drawn to scale. For purposes of clarity, the same reference numbers will be used in the drawings to identify similar elements.

Exemplary embodiments will now be described in detail with reference to the accompanying drawings.

FIG. 1 is a block diagram of a safety system 1 according to various embodiments.

Referring to FIG. 1, the safety system 1 comprises an in-vehicle system 10 and a plurality of mobile devices 20. The in-vehicle system 10 may be provided inside of a vehicle (not shown), such as a car, truck, van, sport-utility vehicle, or the like. Non-limiting examples of the mobile device 20 may include a wireless phone, cell phone, mobile phone, smart phone, tablet, smart watch, in-dash navigation unit, portable navigation unit, in-dash multi-information display unit, or the like. An in-dash multi-information display unit may be integrated with the vehicle and may function to display important vehicle information, such as a real-time image of a rear camera of the vehicle while the vehicle is traveling in a reverse direction.

According to various embodiments, the in-vehicle system 10 comprises a control unit 11, input devices 12, and a communication unit 13. The control unit 11 may include a processor and memory as main components, where the processor executes a program stored in memory to provide the functions of the control unit 11 described below, such as to provide a redundant alerting system to prevent unattended vehicular occupants. The control unit 11 may be a single unit or it may include a plurality of units, and the control unit 11 may be integrated with a control unit of the vehicle or may be a standalone unit provided inside of the vehicle.

The input devices 12 are communicatively connected to the control unit 11 and may transmit a signal to the control unit 11 that indicates a condition that will cause the control unit 11 to arm the redundant alerting system. In some embodiments, input devices 12 may include a motion/image sensor, such as a motion-sensing camera, that may transmit a signal to the control unit 11 that indicates an occupant is present in the vehicle. For example, the motion/image sensor may transmit a signal to the control unit 11 that indicates an occupant other than the driver is present in the vehicle. In another example, input devices 12 may include a sensor to detect a state of the vehicle, such as whether the vehicle is in a parked state, and may transmit a signal to the control unit 11 that indicates the vehicle is in a parked state. In yet another example, input devices 12 may include a sensor to detect a state of the vehicle doors, such as whether the vehicle doors are opened or closed, and may transmit a signal to the control unit 11 indicating the state of the vehicle doors.

The communication unit 13 is functionally connected to the control unit 11 and may include a transceiver configured to transmit and receive information for the control unit 11 via a wireless or wired network. For example, the control unit 11 may be in communication with mobile device 20 via communication unit 13.

In some embodiments, the mobile device 20 comprises a control unit 21, input devices 22, output devices 23, and a communication unit 24. The control unit 21 may include a processor and memory as main components, where the processor executes a program stored in memory to provide the functions of the control unit 21. For example, the control unit 21 may execute an application 25 that works in conjunction with the redundant alerting system to provide alerts to a user.

The input devices 22 allow a user to provide an input to mobile device 20 to disarm the redundant alerting system, and non-limiting examples of the input devices 22 may include a keypad, touchpad, touch screen, and microphone. The output devices 23 provide an indication to a user of an alert from the redundant alerting system, and non-limiting examples of the output devices may include a screen, speakers, and a vibration device. Input devices 22 may be incorporated with the output devices 23, such as a touch-sensitive, graphical user interface.

Communication unit 24 is functionally connected to the control unit 21 and may include a transceiver configured to transmit and receive information for the control unit 21 via a wireless or wired network, such as network 2. For example, the control unit 21 may be in communication with in-vehicle system 10 via communication unit 24. The network 2 may be through a cellular provider, wireless local area network or other communications protocol, such as Bluetooth or IrDA, or wired connection, such as Ethernet.

Figure 2:
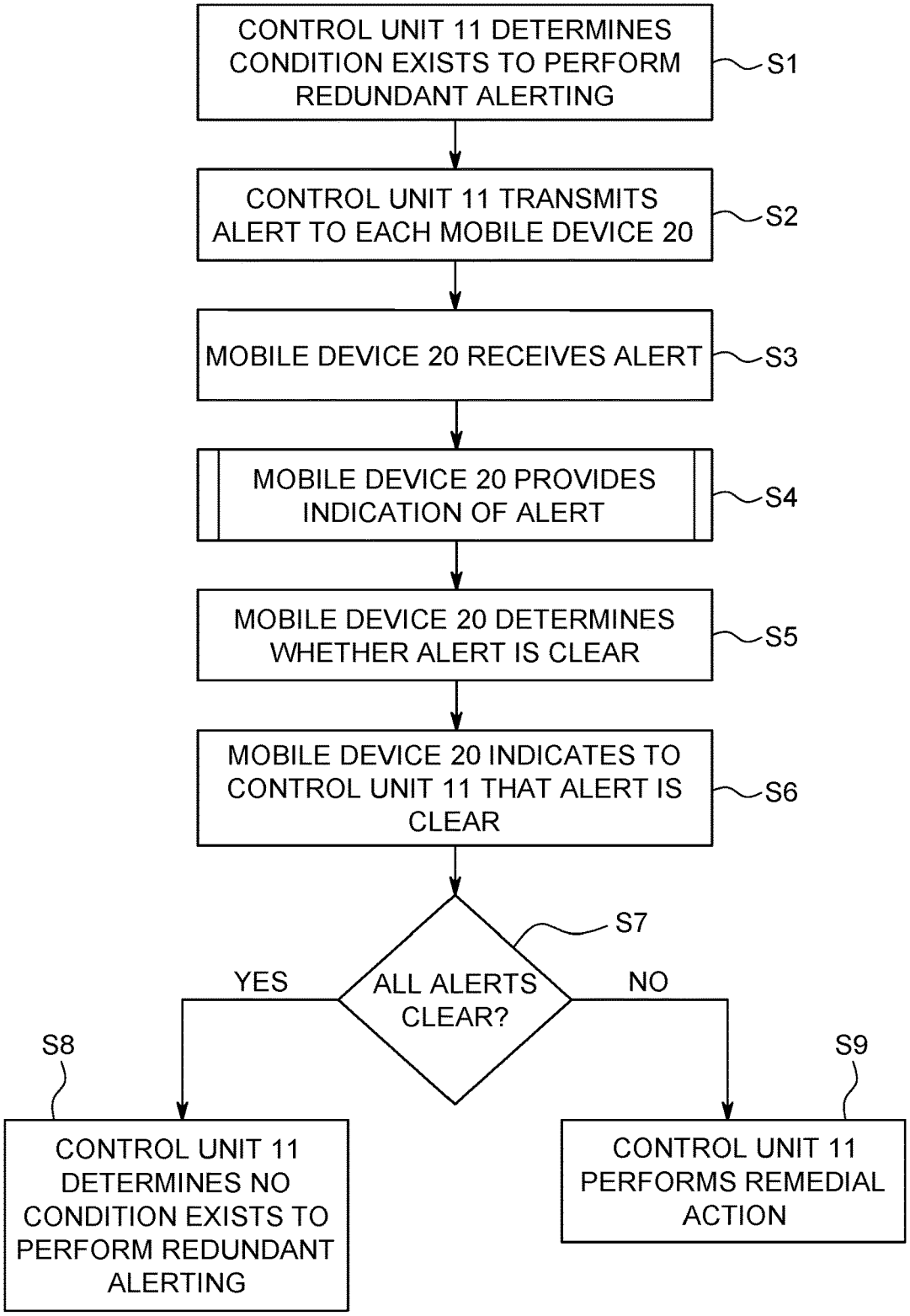
FIG. 2 is a flowchart illustrating an exemplary method according to various embodiments.

FIG. 2 is a flowchart illustrating an exemplary method for redundant alerting according to various embodiments, which may also describe the operation of the safety system 1 described above. It shall be understood that functions described as being performed by the mobile devices 20 may be performed by way of respective control units 21 in conjunction with other described elements of mobile devices 20 as will be evident.

The method begins when the control unit 11 determines that a condition exists to perform redundant alerting based on at least one input from at least one input device 12 (step S1). For example, the condition may be that an occupant other than the driver is detected in the vehicle, or that the vehicle is detected to be in a parked state. In another example, the condition may be that the vehicle is detected to be in a parked state, the vehicle doors have been closed for a predetermined amount of time (e.g., five minutes), and any occupant is detected in the vehicle.

Next, based on the determination, the control unit 11 transmits an alert to each of a plurality of mobile devices 20 (step S2). The control unit 11 may transmit each alert at the same time, or may stagger transmission of alerts by a predetermined time, such as two minutes. For example, the control unit 11 may transmit an alert to a multi-information display unit installed in the dashboard of the vehicle, and then two minutes later the control unit 11 may transmit respective alerts to a smart watch of the driver of the vehicle and a smart phone of another person. In another example, the control unit 11 may only transmit an alert to a mobile phone of the driver and an alert to a mobile phone of another person.

Each of the plurality of mobile devices 20 receives the alert from the control unit 11 (step S3). Then, each mobile device 20 may provide an indication of the alert via its output devices 23 (step S4). For example, the mobile device 20 may provide the indication on a screen of the mobile device 20 through application 25 installed on the mobile device 20. In some embodiments, the alert may include a real-time image of the interior of the vehicle, such as provided by a camera provided inside the vehicle. The mobile device 20 may also provide an audio alert through a speaker, which may be audible even if the mobile device 20 is in a silence or vibrate mode, or a vibration alert. The alert may also prompt the user to provide an input via input devices 22 of the mobile device 20 to clear the alert. For example, the alert may request the user to enter a code via keypad, where the code must match a predetermined code to clear the alert, and where the predetermined code may be factory-installed or user-defined. The alert is periodically reasserted if the user does not enter the matching code within a predetermined amount of time, such as two minutes.

In some embodiments, the mobile device 20 determines whether the alert is cleared based on an input from the user (step S5). For example, the mobile device 20 may determine that the input provided by the user matches a predetermined code to clear the alert. However, if the input provided by the user does not match the predetermined code, then the user may be prompted to try again. Then, the mobile device 20 indicates to the control unit 11 of the in-vehicle system 10 that the alert has been cleared (step S6).

The control unit 11 determines whether alerts have been cleared for each of the plurality of mobile devices 20 within a predetermined amount of time (step S7). For example, the predetermined amount of time may be two minutes. However, other amounts of time may be suitable, such as five minutes or ten minutes.

If, at step S7, the control unit 11 determines that all alerts have been cleared for each of the plurality of mobile devices 20 within the predetermined amount of time, then the control unit 11 determines that the condition for redundant alerting no longer exists (step S8) and the process ends.

However, if, at step S7, the control unit 11 determines that alerts have not been cleared for all of the plurality of mobile devices 20 within the predetermined amount of time, then the control unit 11 performs remedial action and the process ends (step S9). For example, the control unit 11 may cause an alarm or the vehicle horn to sound, where the vehicle horn may make a distinctive blast or a distinctive series of blasts. Other examples of remedial action may be causing the vehicle doors to unlock or causing the vehicle windows to open. The control unit 11 may also transmit a distress signal to local emergency services that may include location information of the vehicle, such as GPS coordinates.

In some embodiments, the remedial action may include returning to step S2 to transmit another alert to each mobile device 20. In other words, the control unit 11 may transmit another alert to each mobile device 20 even if a given mobile device of the plurality of mobile devices 20 has cleared its respective alert. For example, if at step S2 the control unit 11 transmits an alert to a mobile phone of the driver and an alert to a mobile phone of another person, and at step S7 the control unit 11 determines that the alert to the mobile phone of the other person has been cleared but the alert to the driver has not been cleared within the predetermined amount of time, then at step S9 the control unit 11 may return to step S2 to transmit another alert to both the mobile phone of the driver as well as the mobile phone of the other person.

Figure 3:
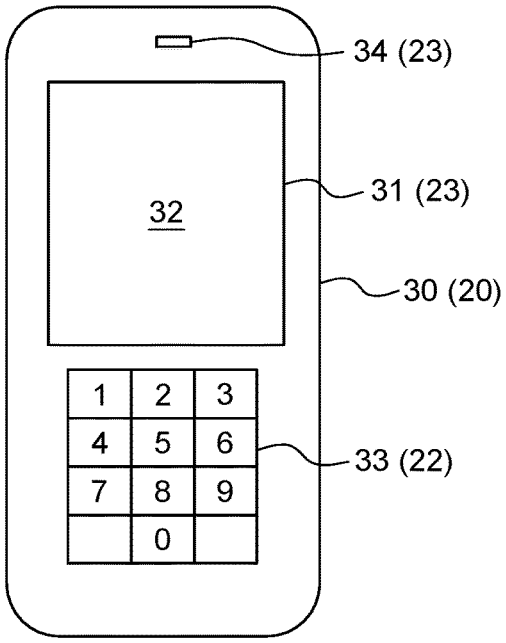
FIG. 3 is a front view of an exemplary device in accordance with various embodiments.

FIG. 3 is a front view of a mobile phone 20 in accordance with various embodiments.

Referring to FIG. 3, in some embodiments, the mobile device 20 may be a cell phone 30. In an exemplary embodiment, the alert 31 may be displayed in a screen 32 of the cell phone 30. As discussed above, the alert may include a real-time image of the interior of the vehicle, such as provided by a camera provided inside the vehicle, and may also prompt the user to provide an input via keypad 33 of the cell phone 30 to clear the alert. Additionally or alternatively, the cell phone 30 may also provide a vibration alert or an audio alert through a speaker 34, which may be audible even if the cell phone 30 is in a silence or vibrate mode.

Figure 4:
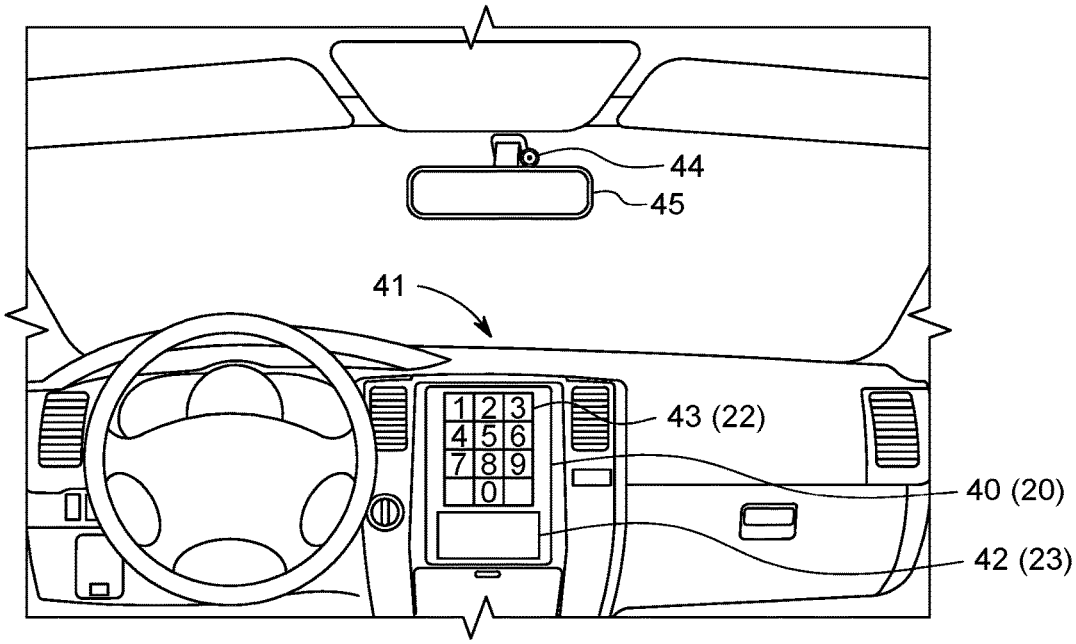
FIG. 4 is a forward view of an exemplary configuration of a vehicle in accordance with various embodiments.

FIG. 4 is a forward view of the interior of the vehicle in accordance with various embodiments.

Referring the FIG. 4, in some embodiments, the mobile device 20 may be a multi-information display unit 40 installed in the dashboard 41 of the vehicle. In an exemplary embodiment, the alert provided by the multi-information display unit 40 may simultaneously include a real-time image 42 of the interior of the vehicle as well as a keypad prompt 43 for the user to enter the code to clear the alert. For example, the real-time image 42 may be provided by a camera 44 mounted on the rear-view mirror 45 of the vehicle, or by a camera (not shown) mounted in the interior of the vehicle, such as mounted overhead between the first and second rows of seats or between the second and third rows of seats or mounted behind a seat in the first or second rows. The camera 44 may communicate with the multi-information display 30 through wired or wireless communication. In some embodiments, the aforementioned cameras 34 may be motion-sensing cameras configured to transmit a signal indicating an occupant other than the driver is present in the vehicle.

Figure 5A:
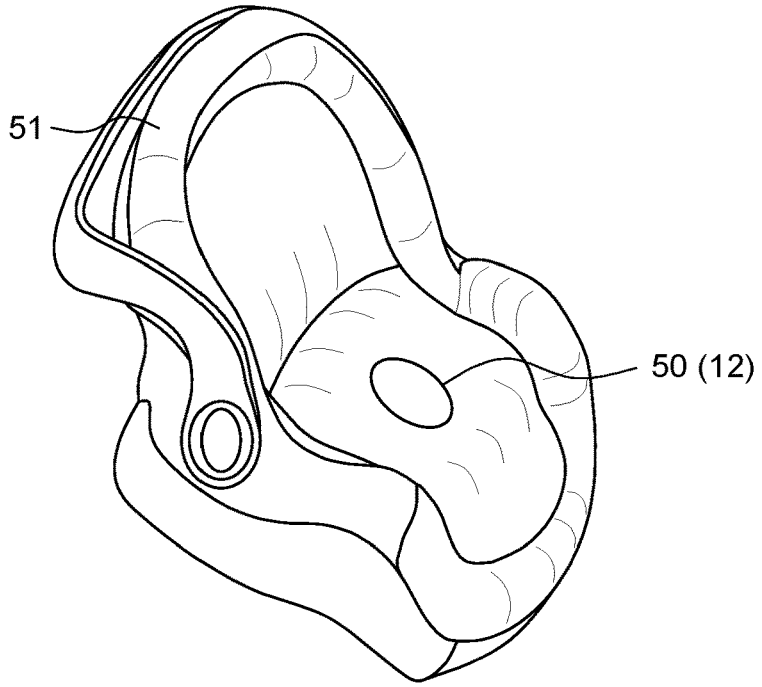
FIGS. 5A-B are perspective views of an exemplary configuration of a car seat in accordance with various embodiments.

FIG. 5A is a perspective view of a car seat 51 configured with an occupant sensor 50 in accordance with various embodiments.

Referring to FIG. 5A, in some embodiments, the input devices 12 of the in-vehicle system 10 may include an occupant sensor 50. The occupant sensor 50 may detect an occupant, such as a child, based on a weight or pressure applied thereon and transmits a corresponding signal to control unit 11. The occupant sensor 50 may be encased in a thin, flexible rubber or silicone material for waterproofing, and may easily be installed in a car seat 51.

Figure 5B:
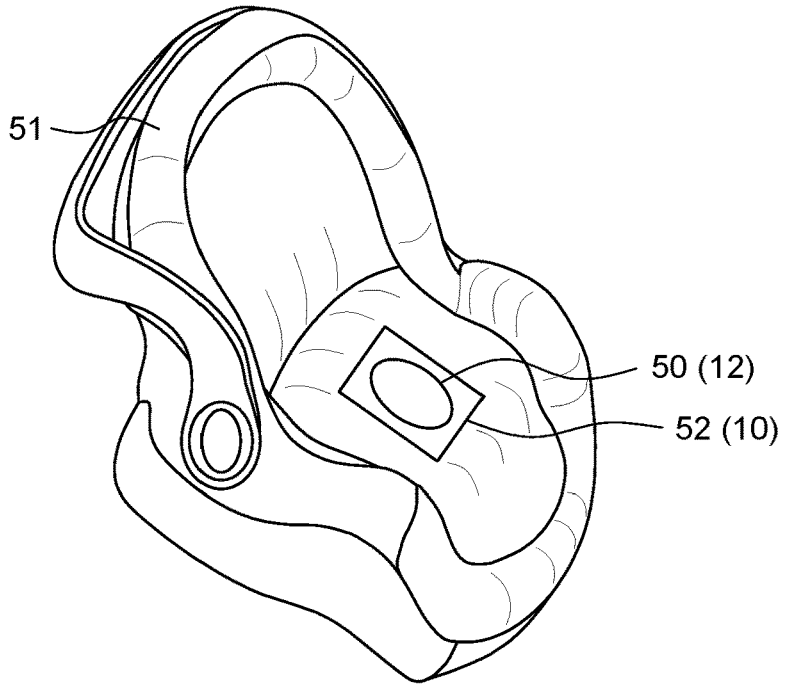

FIG. 5B is a perspective view of a car seat 51 configured with an occupant sensor 50 in accordance with various embodiments.

Referring to FIG. 5B, in some embodiments, the in-vehicle system 10 may be provided as occupant sensing unit 52. The occupant-sensing unit 52 may be encased in a thin, flexible rubber or silicone material for waterproofing, and may easily be installed in a car seat 51. The occupant sensor 50, as discussed above, may be included in the occupant-sensing unit 52, and may detect an occupant, such as a child, based on a weight or pressure applied thereon. The occupant sensor 50 may then transmit a corresponding signal to control unit 11 of occupant-sensing unit 52.

In an exemplary embodiment, the occupant-sensing unit 52 may further include a GPS device (not shown) that provides location information, such as GPS coordinates, to control unit 11. Control unit 11 may then transmit a distress signal including such location information to emergency services, such as discussed above in connection with step S7.

In another exemplary embodiment, the control unit 11 provided in occupant-sensing unit 52 may be configured to remotely activate certain features of the vehicle. For example, the control unit 11 may be configured to remotely cause an alarm or the vehicle horn to sound, where the vehicle horn may make a distinctive blast or a distinctive series of blasts. Additionally or alternatively, the control unit may be configured to remotely control electronic locks or electronic windows of the vehicle.

Figure 6:
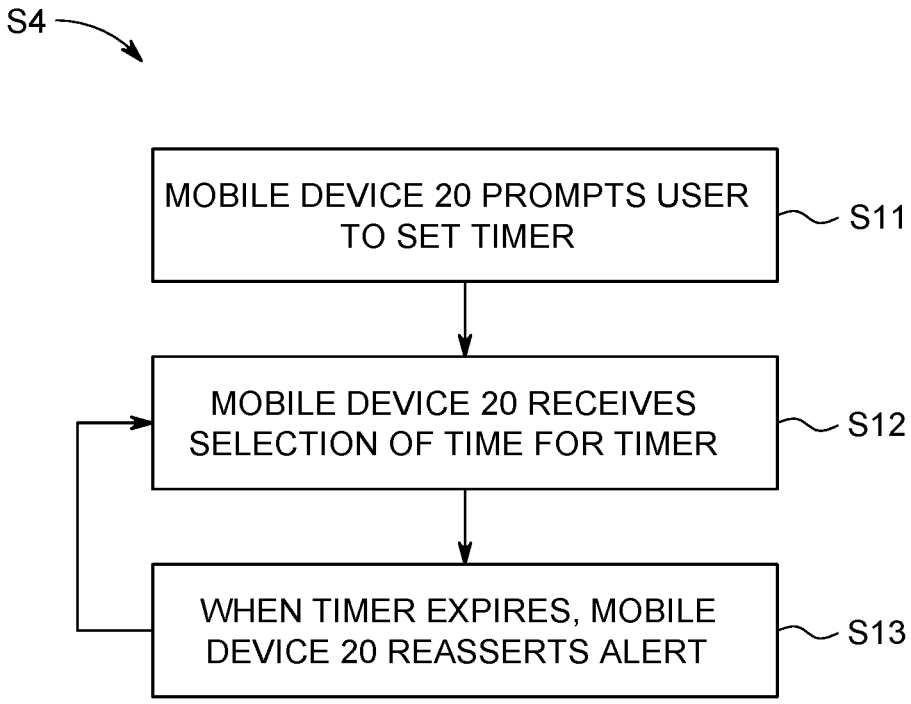
FIG. 6 is a flowchart illustrating additional exemplary method step according to various embodiments.

FIG. 6 is a flowchart illustrating additional exemplary method steps to provide an indication of an alert in accordance with various embodiments.

Referring to FIGS. 1 and 6, if, at step S1, the control unit 11 determines that a condition exists to perform redundant alerting based on an indication from occupant sensor 50, then the processing at step S4 may include further processing where the mobile device 20 may prompt the user to set an amount of time for a timer (step S11). For example, the mobile device 20 may prompt the user to set an amount of time via application 25 displayed on the screen. Alternatively or additionally, the mobile device 20 may request the user to set a time through an audio alert via a speaker. Then, the mobile device 20 may receive a user selection of an amount of time via the input devices 22 (step S12). For example, the user may manually enter an amount of time through a keypad or touch screen, or may verbally enter an amount of time through a microphone. The amount of time for the timer may correspond to an approximation of an amount of time the user expects to be in the vehicle, and may correspondingly extend the predetermined amount of time used in the determination at step S7.

Upon expiration of the timer, the alert will be reasserted and the user will be prompted with a choice to enter the code to clear the alert or to further extend an amount of time on the timer (step S13). In other words, setting additional time on the timer temporarily clears the alert until another expiration of the timer. The alert is periodically reasserted if the user does not enter the matching code or an amount of time to extend the timer within a predetermined amount of time, such as two minutes. The user may repeatedly extend the amount of time on the timer to proceed back to step S12, or the process will continue at step S5 once the user enters the matching code. However, the control unit 11 will perform remedial action if it is determined that all of the alerts have not been cleared for the plurality of mobile devices 20 within the predetermined amount of time in accordance with steps S7 and S9.

EXAMPLE APPLICATIONS

The various exemplary embodiments described above may be applied to both newer and older vehicles regardless of vehicle features in order to achieve the aforementioned advantages.

For example, a newer vehicle may include a multi-information display unit provided in the dashboard and a rear-facing camera provided on the rear-view mirror or overhead between the first and second rows of seats or the second and third rows of seats. When the vehicle is in park, an alert may be displayed on the multi-information display unit, and the alert may include a real-time image of the interior of the vehicle captured by the camera. In this manner, the driver may view the contents of the interior of the vehicle behind the driver, and may be reminded of a sleeping child in the rear of the vehicle that needs to be attended to, for example. The driver may also be reminded of the sleeping child by being prompted to enter a required code via a keypad also included in the alert.

As a fail-safe, respective alerts may be sent to the driver's mobile phone and as well as another person's mobile phone prompting the code to be entered again. In this manner, even if the driver becomes distracted after correctly entering the code on the multi-information display unit and forgets to attend to the sleeping child, the driver may be reminded again thereby reducing the risk of the child being left unattended in the vehicle. Additionally, alerting the other person and requiring the code to be entered on the other person's phone may further reduce the risk of the child being left unattended in the vehicle.

Remedial action may be taken if all of the alerts are not cleared within a certain amount of time. For instance, the vehicle doors may be electronically unlocked and the windows may be electronically opened, or the horn may be activated to blow a distinctive blast or series of blasts. Emergency services may also be contacted with location information of the vehicle. In this manner, a potentially dangerous situation for an unattended occupant left in a vehicle may be avoided.

In another example, an older vehicle may not include the multi-information display unit provided in the dashboard or the rear-facing camera to provide a real-time image of the interior of the vehicle. In such an instance, an occupancy sensor may be installed in a child's car seat to detect a weight or pressure of a child sitting thereon, for instance. When a child is detected, an alert is output from the driver's mobile phone that prompts the user to select an amount of time for a timer corresponding to an expected duration of the trip in the vehicle. Another alert is output from the driver's mobile phone upon the expiration of the timer, at which point the driver may extend the timer by selecting another amount of time or may enter a code to clear the alert. In this manner, the driver may be reminded of the child before leaving the vehicle after completing the trip. Furthermore, even if the driver takes a detour, for example, and the timer expires before completing the trip, the driver may be reminded again with an additional alert to attend to the child.

Remedial action may be taken if all of the alerts are not cleared within a certain amount of time. For instance, the occupant sensor may be included as part of an occupant-sensing unit installed in the child's car seat, where the occupant-sensing unit may be configured to remotely activate features of the vehicle, such electronically unlocking the doors, electronically opening the windows, or activating the horn to blow a distinctive blast or series of blasts. The occupant-sensing unit may also include a GPS device that can determine location information, and the occupant-sensing unit may contact emergency services with the location information. In this manner, a potentially dangerous situation for an unattended occupant left in a vehicle may be avoided even if the vehicle lacks certain features or capabilities.

In yet another example, a situation may arise when a child re-enters a vehicle unattended after redundant alerting has been completed. For instance, an adult may be reminded to remove to a child from a vehicle upon arrival at a destination through redundant alerting, but the child may re-enter the vehicle while the adult is distracted, such as while unloading the vehicle or operating a mobile phone. In such an instance, if at least one sensor detects that the vehicle doors have been closed for a predetermined amount of time, such as five minutes, that the vehicle is in a parked state, and that a person is detected in the vehicle, such as by movement detected with a motion-sensing camera, then redundant alerts may be sent to multiple mobile phones. For example, the alert may include a real-time image of the interior of the vehicle provided by the motion-sensing camera.

In a similar manner as the previous examples, remedial action may be taken if the redundant alerts are not cleared within the predetermined amount of time. For example, the vehicle doors may be electronically unlocked and the windows may be electronically opened, or the horn may be activated to blow a distinctive blast or series of blasts. Emergency services may also be contacted with location information of the vehicle. Accordingly, children may be further prevented from being left unattended in a vehicle even after one or more performances of redundant alerting.

Various embodiments have been described with reference to the accompanying drawings. As is apparent from the foregoing description, the various embodiments address the need in the art for a manner of alerting to ensure that a child passenger does not remain in the vehicle unattended. Particularly, redundant alerts are presented on multiple devices to alert multiple different people of an unattended occupant, such as a child or even a pet animal, in a vehicle. In some cases, further remedial action may be taken to alarm local passersby or emergency services of the unattended occupant. Accordingly, there are multiple layers of security to prevent an unattended occupant from remaining in a potentially dangerous situation such as an overheating vehicle.

Moreover, the various embodiments are necessarily rooted in computer technology in order to overcome problems specifically arising in the realm of vehicular safety and communication technologies. In particular, the various embodiments include features that are an improvement over related technology and methodology, such as intelligent redundant alerting to multiple parties of an unattended occupant of a vehicle. Accordingly, the unattended occupant is prevented from harm even if at least one of the parties is distracted during or after an alert, for example.

Embodiments may include various steps as set forth above. The steps may be embodied in computer-executable instructions that cause a general-purpose or special-purpose processor to perform certain steps. Various elements that are not relevant to these underlying principles such as computer memory, hard drive, and input devices may have been left out of some or all of the figures to avoid obscuring the pertinent aspects.

Elements of the disclosed subject matter may also be provided as a computer program product that may include a computer readable medium having stored thereon computer-executable instructions that may be used to program a computer (e.g., a processor or other electronic device) to perform a sequence of operations. Alternatively, the operations may be performed by a combination of hardware and software. The computer readable medium may include, but is not limited to, flash memory, optical disks, CD-ROMS, DVD ROMs, RAMs, EPROMs, EEPROMs, magnetic or optical cards, or other types of computer readable media suitable for storing instructions.

Additionally, although the disclosed subject matter has been described in conjunction with specific embodiments, numerous modifications and alterations are well within the scope of the present disclosure. Accordingly, the specification and drawings are to be regarded in an illustrative rather than a restrictive sense.

The invention claimed is:

1. A safety system for redundant alerting to prevent unattended vehicular occupants in a vehicle, the safety system comprising:

an in-vehicle system comprising:

a first processor; and at least one input device that transmits at least one signal to the first processor, wherein the at least one signal comprises a signal indicating that an unattended occupant is detected in the vehicle wherein the first processor determines that a condition exists to perform redundant alerting based on the at least one signal from the at least one input device and transmits an alert to each of a plurality of mobile devices; and each of the plurality of mobile devices comprising:

an output device; and a second processor that provides the alert from the first processor to a user through the output device, determines whether the alert has been cleared by a user input, and indicates to the first processor that the alert has been cleared by the user input in response to the second processor determining that the alert has been cleared by the user input, wherein the first processor determines whether all transmitted alerts to the plurality of mobile devices have been cleared by each one of the plurality of user inputs associated with the plurality of mobile devices within a first predetermined amount of time, and wherein the first processor performs a remedial action in response to the first processor determining that not all of the alerts transmitted to the plurality of mobile devices have been cleared by each one of the plurality of user inputs associated with the plurality of mobile devices within the first predetermined amount of time;

wherein the first processor determines that all of the alerts transmitted to the plurality of mobile devices have been cleared by each one of the plurality of user inputs associated with the plurality of mobile devices within the first predetermined amount of time;

after the first processor determines that all of the alerts transmitted to the plurality of mobile devices have been cleared by each one of the plurality of user inputs associated with the plurality of mobile devices within the first predetermined amount of time, the first processor determines that another condition exists to perform redundant alerting based on at least a second signal from the at least one device indicating that an unattended occupant has re-entered the vehicle and transmits another alert to each of the plurality of mobile devices; and the at least second signal from the at least one device indicating that an unattended occupant has reentered the vehicle comprises a signal indicating that doors of the vehicle have been closed for a second predetermined amount of time, a signal indicating that the vehicle is in a parked state, and a signal indicating that motion of the unattended occupant is detected in the vehicle.

2. The safety system according to claim 1, wherein the at least one input device comprises a motion-sensing camera, a weight sensor, or a pressure sensor.

3. The safety system according to claim 1, wherein the at least one signal further comprises a signal indicating that the vehicle is in a parked state or a signal indicating that doors of the vehicle have been closed for a third predetermined amount of time.

4. The safety system according to claim 1, wherein the plurality of mobile devices comprises two mobile phones.

5. The safety system according to claim 4, wherein the plurality of mobile devices further comprises a multi-information display unit of the vehicle.

6. The safety system according to claim 1, wherein:

the alert comprises a prompt to input a code to clear the alert, and the second processor determines that the alert is cleared by the user input matching a predetermined code.

7. The safety system according to claim 1, wherein the alert comprises a real-time image of an interior of the vehicle.

8. The safety system according to claim 1, wherein the alert comprises a prompt to set a timer to temporarily clear the alert; and the second processor determines that the alert is cleared by the user input selecting an amount of time to temporarily clear the alert.

9. The safety system according to claim 1, wherein the remedial action comprises at least one of electronically unlocking at least one door of the vehicle, electronically opening at least one window of the vehicle, electrically causing an alarm or horn to sound, and transmitting a message to emergency services.

10. A safety method for redundant alerting to prevent unattended vehicular occupants in a vehicle, the safety method comprising:

transmitting, by at least one input device, at least one signal to a first processor of an in-vehicle system, wherein the at least one signal comprises a signal indicating that an unattended occupant is detected in the vehicle;

determining, by the first processor, that a condition exists to perform redundant alerting based on the at least one signal;

transmitting, by the first processor, a respective alert to each of a plurality of mobile devices in response to determining that the condition exists;

providing, by a respective second processor of each of the plurality of mobile devices, the respective alert from the first processor to a respective user through a respective output device of each of the plurality of mobile devices;

determining, by the respective second processor, whether the alert has been cleared by a user input;

indicating, by the respective second processor, to the first processor that the respective alert has been cleared by the user input in response to the respective second processor determining that the alert has been cleared by the user input;

determining, by the first processor, whether all alerts to the plurality of mobile devices have been cleared by each one of the plurality of user inputs associated with the plurality of mobile devices within a first predetermined amount of time; and performing, by the first processor, a remedial action in response to the first processor determining that not all of the alerts transmitted to the plurality of mobile devices have been cleared by each one of the plurality of user inputs associated with the plurality of mobile devices within the first predetermined amount of time;

wherein the first processor determines that all of the alerts transmitted to the plurality of mobile devices have been cleared by each one of the plurality of user inputs associated with the plurality of mobile devices within the first predetermined amount of time;

after the first processor determines that all of the alerts transmitted to the plurality of mobile devices have been cleared by each one of the plurality of user inputs associated with the plurality of mobile devices within the first predetermined amount of time, the first processor determines that another condition exists to perform redundant alerting based on at least a second signal from the at least one device indicating that an unattended occupant has re-entered the vehicle and transmits another alert to each of the plurality of mobile devices; and the at least second signal from the at least one device indicating that an unattended occupant has reentered the vehicle comprises a signal indicating that doors of the vehicle have been closed for a second predetermined amount of time, a signal indicating that the vehicle is in a parked state, and a signal indicating that motion of the unattended occupant is detected in the vehicle.

11. The safety method according to claim 10, the at least one input device comprises a motion-sensing camera, a weight sensor, or a pressure sensor.

12. The safety method according to claim 10, wherein the transmitting at least one signal to the first processor further comprises transmitting a signal indicating that the vehicle is in a parked state or a signal indicating that doors of the vehicle have been closed for a third predetermined amount of time.

13. The safety method according to claim 10, wherein the plurality of mobile devices comprises two mobile phones.

14. The safety method according to claim 13, wherein the plurality of mobile devices further comprises a multi-information display unit of the vehicle.

15. The safety method according to claim 10, wherein the providing the respective alert comprises displaying a prompt to input a code to clear the respective alert, the method further comprising:

determining, by the respective second processor, that the respective alert is cleared by the user input matching a predetermined code.

16. The safety method according to claim 10, wherein the providing the respective alert comprises displaying a real-time image of an interior of the vehicle.

17. The safety method according to claim 10, wherein the providing the respective alert comprises displaying a prompt to set a timer to temporarily clear the alert, the method further comprising:

determining, by the respective second processor, that the respective alert is cleared by the user input selecting an amount of time to temporarily clear the respective alert.

18. The safety method system according to claim 10, wherein the performing the remedial action comprises at least one of electronically unlocking at least one door of the vehicle, electronically opening at least one window of the vehicle, electrically causing an alarm or horn to sound, and transmitting a message to emergency services.

* * * * *